US008033843B2

(12) United States Patent
Ambo et al.

(10) Patent No.: US 8,033,843 B2
(45) Date of Patent: Oct. 11, 2011

(54) LEVER TYPE CONNECTOR

(75) Inventors: Tsugio Ambo, Saitama (JP); Yoshikazu Tanaka, Saitama (JP); Satoshi Uramatsu, Saitama (JP); Tetsu Hirose, Saitama (JP)

(73) Assignee: Mitsubishi Cable Industries, Ltd., Tokyo (JP)

( * ) Notice: Subject to any disclaimer, the term of this patent is extended or adjusted under 35 U.S.C. 154(b) by 0 days.

(21) Appl. No.: 12/600,607

(22) PCT Filed: May 13, 2008

(86) PCT No.: PCT/JP2008/058773
§ 371 (c)(1),
(2), (4) Date: Jan. 26, 2010

(87) PCT Pub. No.: WO2008/143060
PCT Pub. Date: Nov. 27, 2008

(65) Prior Publication Data

US 2010/0151714 A1 Jun. 17, 2010

(30) Foreign Application Priority Data

May 18, 2007 (JP) ..... 2007-132322

(51) Int. Cl.
*H01R 13/62* (2006.01)

(52) U.S. Cl. ..... 439/157

(58) Field of Classification Search ..... 439/157
See application file for complete search history.

(56) References Cited

U.S. PATENT DOCUMENTS

| | | | | |
|---|---|---|---|---|
| 6,264,485 | B1 | 7/2001 | Saka et al. | |
| 6,413,105 | B2 * | 7/2002 | Noro et al. | 439/157 |
| 6,733,312 | B2 * | 5/2004 | Fujii | 439/157 |
| 7,137,835 | B2 * | 11/2006 | Shiga | 439/157 |
| 7,559,779 | B1 * | 7/2009 | Caines et al. | 439/157 |

FOREIGN PATENT DOCUMENTS

| | | | |
|---|---|---|---|
| EP | 1 094 563 | A2 | 4/2001 |
| JP | 2001-118631 | A | 4/2001 |
| JP | 2003-123896 | A | 4/2003 |
| JP | 2003-3151675 | A | 5/2003 |

OTHER PUBLICATIONS

English Language International Search Report dated Jun. 10, 2008 issued in parent Appln. No. PCT/JP2008/058773.

* cited by examiner

*Primary Examiner* — Truc Nguyen
(74) *Attorney, Agent, or Firm* — Holtz, Holtz, Goodman & Chick, PC

(57) ABSTRACT

A pivoting lever has tongue-like movable pieces formed in a squared U-shape on both side faces of a cover member, and locking claws at intermediate parts of the movable piece. A pivoting lever is pivotally supported on a support pin of the cover member. Circular arc-shaped cam grooves are formed in a lever body part, and locking holes engaging locking claws are formed in the lever body part. When a mating housing is pressed into a housing and the lever is pivoted, the cam grooves drive a driven pin and pull the mating housing toward the housing. The lever contacts the locking claws, and pivots the locking claws while pushing them down. When the housings are joined, the locking claws returned to the original positions fitted into the locking holes, setting the lever to a locked state, thereby disabling further rotation and reverse rotation of the lever.

1 Claim, 7 Drawing Sheets

*Fig.7* *Prior Art*
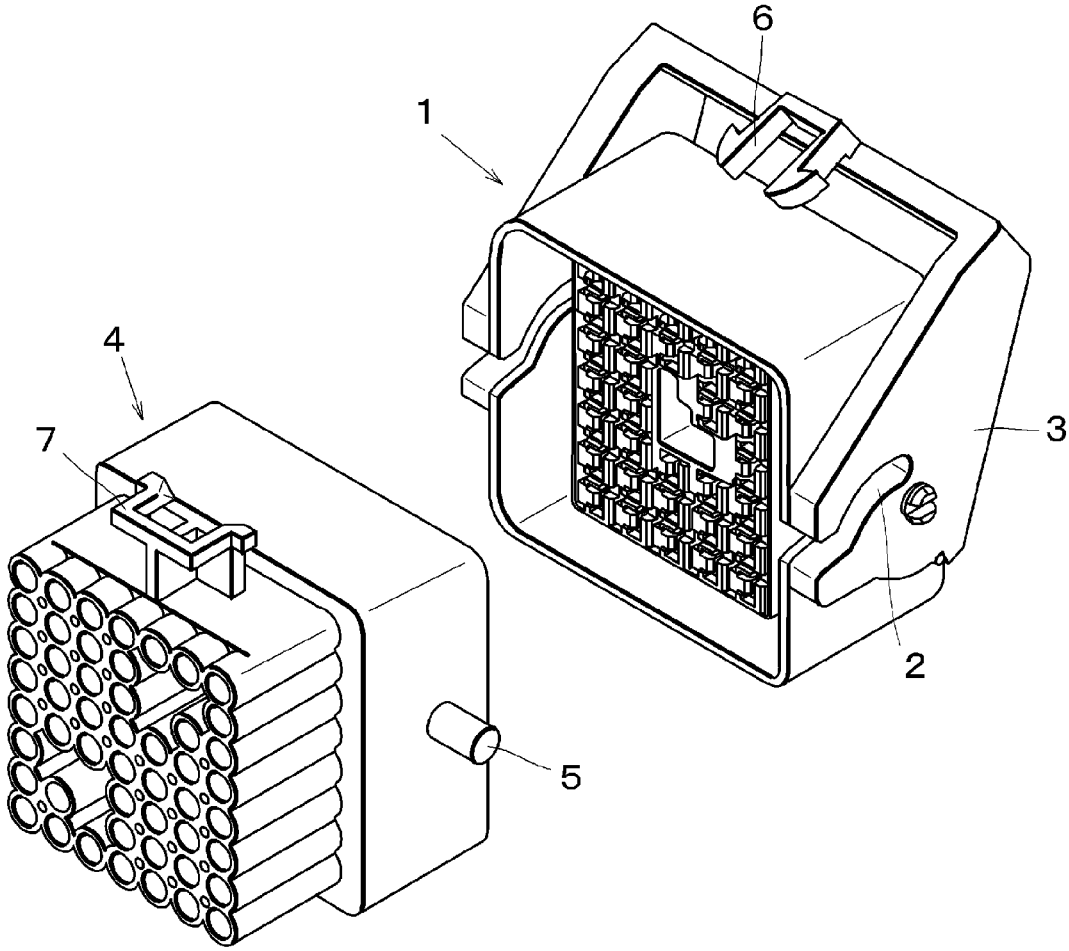

*Fig.8* *Prior Art*
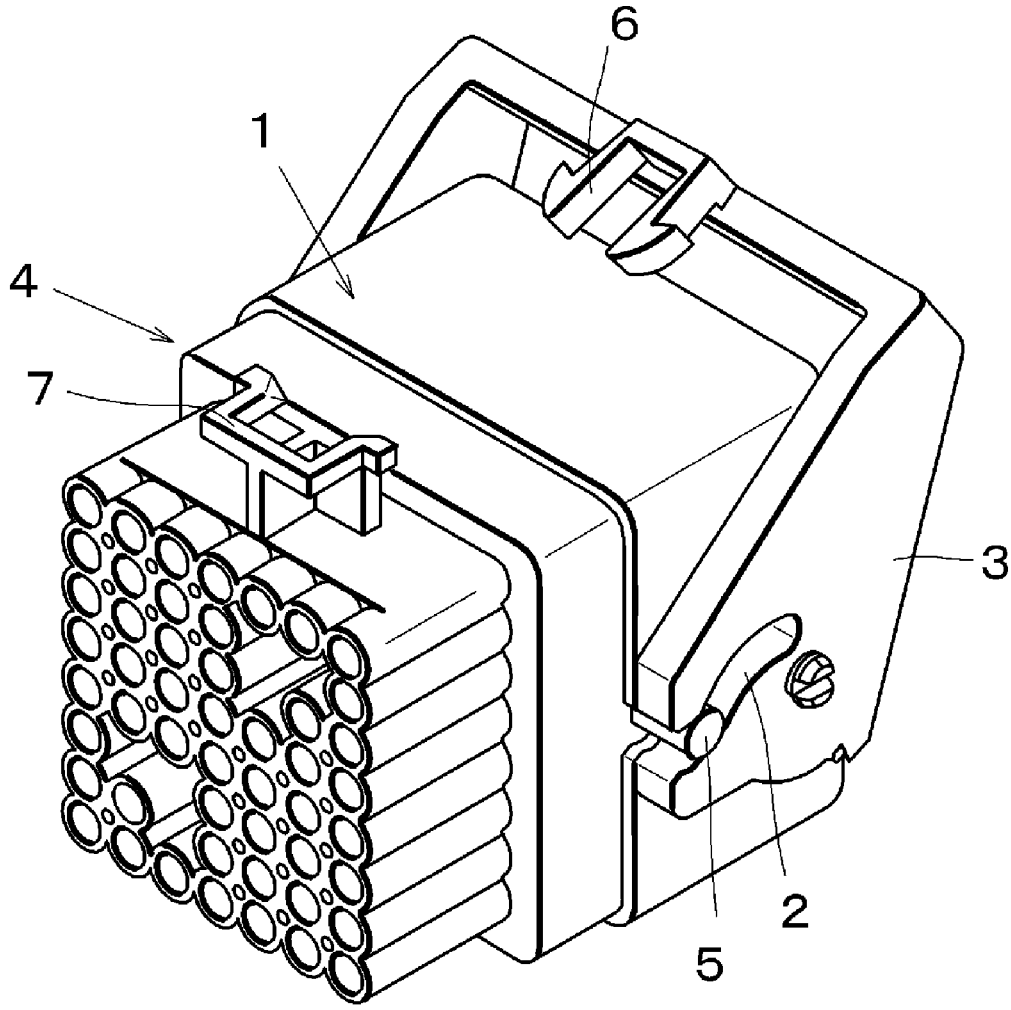

LEVER TYPE CONNECTOR

This application is a U.S. National Phase Application under 35 USC 371 of International Application PCT/JP2008/058773 filed May 13, 2008.

FIELD OF THE INVENTION

The present invention relates to a lever type connector, in which a pair of housings each having a number of connecting terminals installed therein are detachably coupled with each other by means of a rotating lever.

BACKGROUND OF THE INVENTION

Patent Document 1 discloses a known lever type connector. The lever type connector comprises a pair of housings which are detachably coupled with each other. On of the housings has installed therein a number of female type connecting terminals and the other housing also has installed therein a number of male type connecting terminals which may be connected to respective female type connecting terminals. A rotating lever having a cam slit is pivotally provided on the one housing, and a driven pin which may be engaged with the cam slit is formed on the other housing.

As shown in FIG. 7, the known connector includes two housings 1 and 4, and the male housing 1 having the male type connecting terminals installed therein comprises a rotating lever 3 having a cam slit 2 formed therein. The other female housing 4 having the female type connecting terminals installed therein comprises a driven pin 5 which is to be engaged with the cam slit 2 of the rotating lever 3.

At first the male housing 1 and female housing 4 are opposed to each other and the driven pin 5 is placed in opposition to an opening of the cam slit 2 as illustrated in FIG. 8, and then the rotating lever 3 is rotated in a counter-clockwise direction, the driven pin 5 is pulled toward the male housing 1 by the engagement of the driven pin 5 with the cam slit 2. In this manner, the female housing 4 is easily inserted into the male housing 1 without requiring a large force and at the same time the female type connecting terminals are coupled with corresponding male type connecting terminals.

In order to lock the male and female housings 1 and 4 in the engaged condition, a claw portion 6 is provided on the rotating lever 3 and a cooperating receiving portion 7 is provided on the female housing 4. When the claw portion 6 is engaged with the receiving portion 7, the rotating lever 3 could not be accidentally rotated in the clockwise direction, and thus the engaged condition of the housings 1 and 4 is remained.

Patent Document 1: Japanese Patent Laid-open Kokai 2003-123896

DISCLOSURE OF THE INVENTION

Problems To Be Solved By the Invention

The conventional lever type connector just explained above has rather complicated structure, and the rotating lever might be broken if a strong force is applied to the rotating lever. Moreover, it is difficult to check the locked condition.

Although the rotating lever is locked to the cooperating housing, if the housings are not engaged with each other, the rotating lever might be unstable and any trouble might occur during the transportation of the connector.

The present invention has for its object to provide a lever type connector in which the above mentioned drawbacks of the known lever type connector can be removed, and a stable locking condition can be attained by simple structure.

Means For Solving the Problems

According to the invention, in order to achieve the above mentioned object, a lever type connector comprising a housing for accommodating a plurality of connecting terminals and a rotating lever having a cam slit formed therein, by rotating said rotating lever, a cooperating housing being pulled toward said relevant housing to attain an engaged condition in which said cooperating housing is engaged with said relevant housing and a plurality of connecting terminals installed within said cooperating housing are connected to said plurality of connecting terminals installed within said relevant housing, characterized in that said relevant housing comprises a locking mechanism for engaging and locking a part of the rotating lever with a part of the relevant housing in the engaged condition of the relevant housing with the cooperating housing.

Merits of the Invention

In the lever type connector according to the invention, the locking mechanism for locking the engagement of the first housing with the second housing is provided on the first housing, and therefore, when the rotating lever is locked with the first housing while the second housing is not engaged with the first housing, any accidental rotation of the rotating lever can be effectively prevented.

BRIEF DESCRIPTION OF THE DRAWINGS

FIG. 7 is a perspective view showing a known lever type connector; and

FIG. 8 is a perspective view illustrating a condition of the known lever type connector in which first and second housings are coupled with each other.

EXPLANATION OF THE REFERENCE NUMERALS

Figure 1:
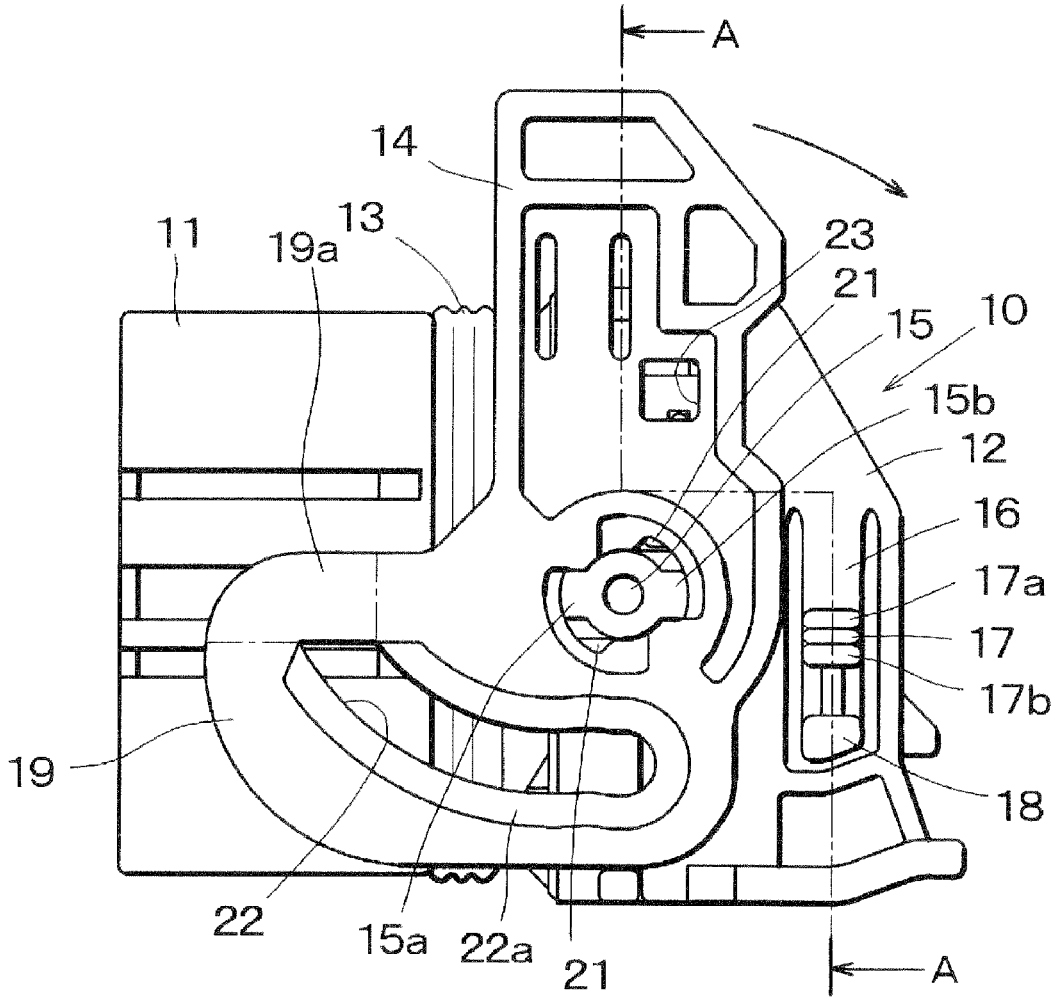
FIG. 1 is a side view showing an embodiment of the lever type connector according to the invention.

10 housing
11 housing main body
12 cover member
14 rotating lever
15 supporting pin
16 movable strip
17 locking claw
18 releasing projection
19 lever main body
22 cam slit
23 locking hole

BEST MODES OF THE INVENTION

Figure 2:
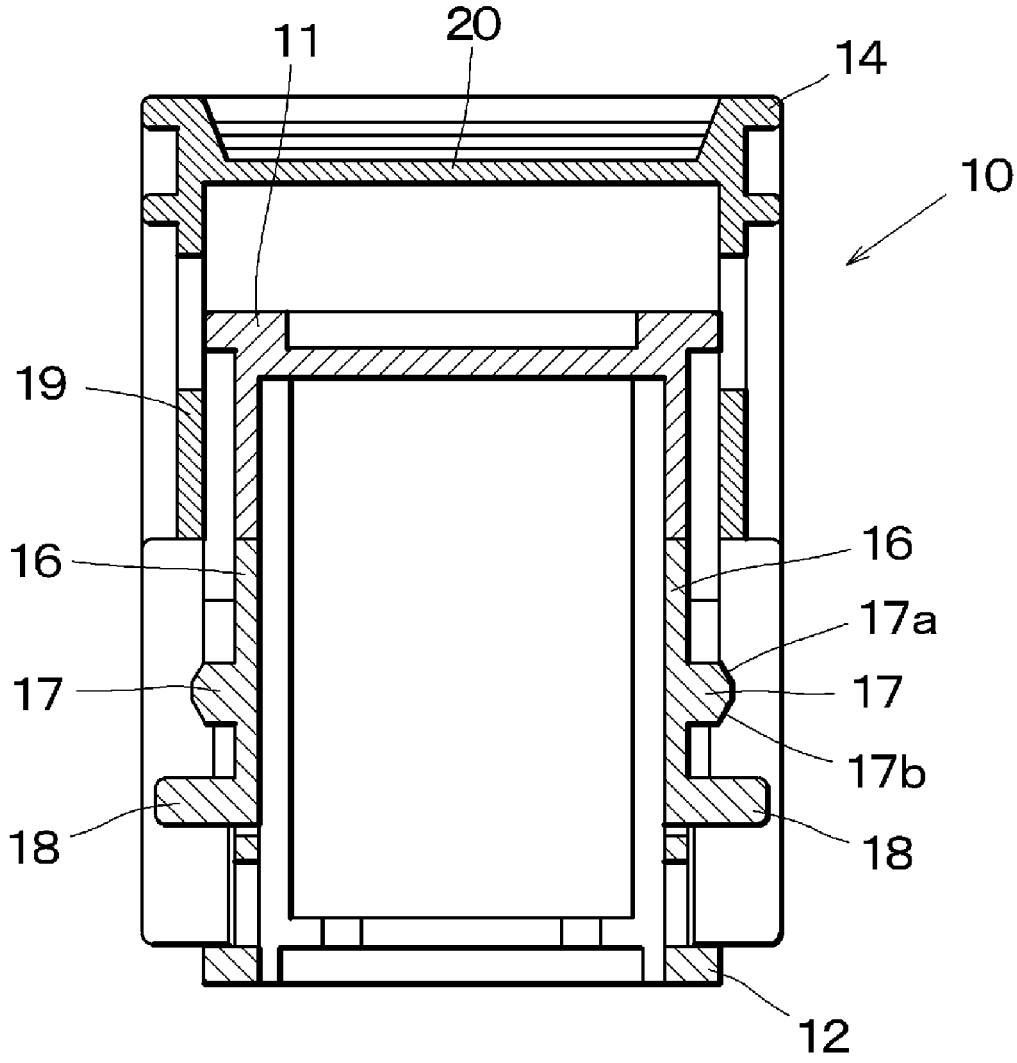
FIG. 2 is a cross sectional view cut along a line A-A in FIG. 1.

Now the present invention will be explained in detail with reference to an embodiment illustrated in the drawings. FIG. 1 is a side view showing an embodiment of the lever type connector according to the invention and FIG. 2 is a cross sectional view thereof. The housing 10 made of a synthetic resin and having a substantially box-like shape comprises a housing main body 11 and a cover member 12 secured to the housing main body 11. Within the housing main body 11 a number of connecting terminals each having an electric wire connected to a rear end thereof are accommodated. The connecting terminals are retained in position within the housing main body 11 by means of flexible locking arms formed integrally with the housing main body 11. A sealing member 13 made of synthetic rubber is applied on an outer surface of the housing main body 11 such that a cooperating housing can be coupled with the housing 10 in a waterproof fashion.

The cover member 12 is provided on a rear portion of the housing main body 11 such that the electric wires connected to the connecting terminals installed within the housing main body 11 are guided by the cover member 12 in a downward direction. In order to pull the cooperating housing toward the housing 10 to engage the cooperating housing with the housing main body 11, a rotating lever 14 having a substantially ㄱ-shape and being made of a synthetic resin is rotatably secured about supporting pins 15 provided on respective side walls of the cover member 12.

Substantially ㄱ-shape tongue-like movable strips 16 are formed in the side walls of the cover member 12 at portions opposite to the housing main body 11 with respect to the supporting pins 15, said movable strips 16 extending substantially along a rotating direction of the rotating lever 14. In order to lock the rotating lever 14 at a given position, at a middle portion of each of the movable strips 16 there is formed locking claw 17 such that the locking claw 17 extends outwardly. On both sides of the locking claw 17 there are formed inclined surfaces 17*a* and 17*b*. At a free end of each of the movable strips 16 there is formed a releasing projection 18 which is protruded outwardly much higher than the locking claw 17.

The rotating lever 14 is formed by a pair of lever main bodies 19 which are supported by the supporting pins 15 to rotate in a direction shown by an arrow and a connecting portion 20 which are connected to the lever main bodies 19 such that the rotating lever 14 is formed to have a substantially ㄱ-shape. It should be noted that the connecting portion 20 serves as an operation handle. At a top end of the supporting pin 15 there are formed two projections 15*a* and 15*b* each of which is protruded into respective one of two recesses 21 formed around a bearing surface of the rotating lever 14 such that the rotating lever 14 can rotate over a predetermined angle.

In each of the lever main bodies 19 of the rotating lever 14, there is formed an inclined surface 22*a* descending from an outer surface of the lever main body and a circular arc cam slit 22 formed at a bottom periphery of the inclined surface 22*a*, said circular arc cam slit 22 being engaged with a driven pin provided on side walls of the cooperating housing such that the cooperating housing is pulled toward the relevant housing 11 to couple the relevant housing 11 with the cooperating housing by rotating the rotating lever 14. In order to introduce the driven pins into the circular arc cam slits 22, guide recesses 19a are formed in inner surfaces of the lever main bodies 19 such that the guide recesses are communicated with the circular arc cam slits 22. Furthermore, in each of the lever main bodies 19 there is formed a rectangular locking hole 23 at a position diagonally opposed to the cam slit 22 with respect to the supporting pin 15, said rectangular locking hole is to be engaged with the locking claw 17.

It should be noted that the locking claw 17 is engaged with the locking hole 23 when the rotating lever 14 has been rotated into the finally engaged position. Therefore, it is preferable that the locking hole 23 is formed in the rotating lever 14 at a position where a radius of rotation is rather large.

Figure 3:
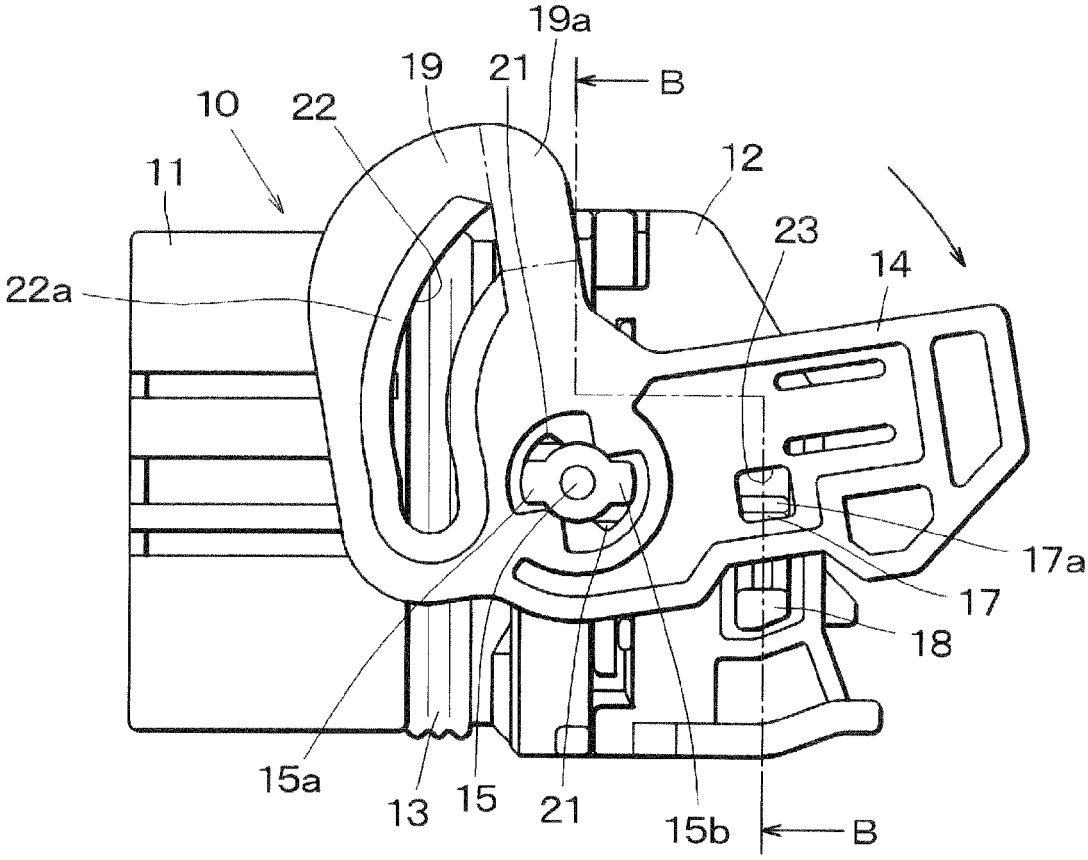
FIG. 3 is a side view illustrating a condition during the rotation of a rotating lever.

Upon coupling the cooperating housing with the relevant housing 11, at first the cooperating housing is manually pushed toward the relevant housing 11 such that the driven pins provided on the side walls of the cooperating housing are urged against the guide recesses 19*a* communicated with the circular arc cam slit 22 of the rotating lever 14, and then the connecting portion 20 of the rotating lever 14 is pushed downward to rotate the rotating lever 14 in a direction shown by an arrow in FIG. 3. During the rotation of the rotating lever 14, the driven pins of the cooperating housing are entered into the cam slits 22 of the relevant housing and the cooperating housing is pulled toward the relevant housing 11 by the engagement of the driven pins with the cam slits 22 to initiate the engagement of the cooperating housing with the relevant housing 11. When a side edge of each of the lever main bodies 19 is brought into contact with the inclined surface 17*a* of each of the locking claws 17 provided on the movable members 16, the locking claws 17 is pushed inwardly as illustrated in FIG. 4, and then the lever main bodies 19 are further rotated.

Figure 5:
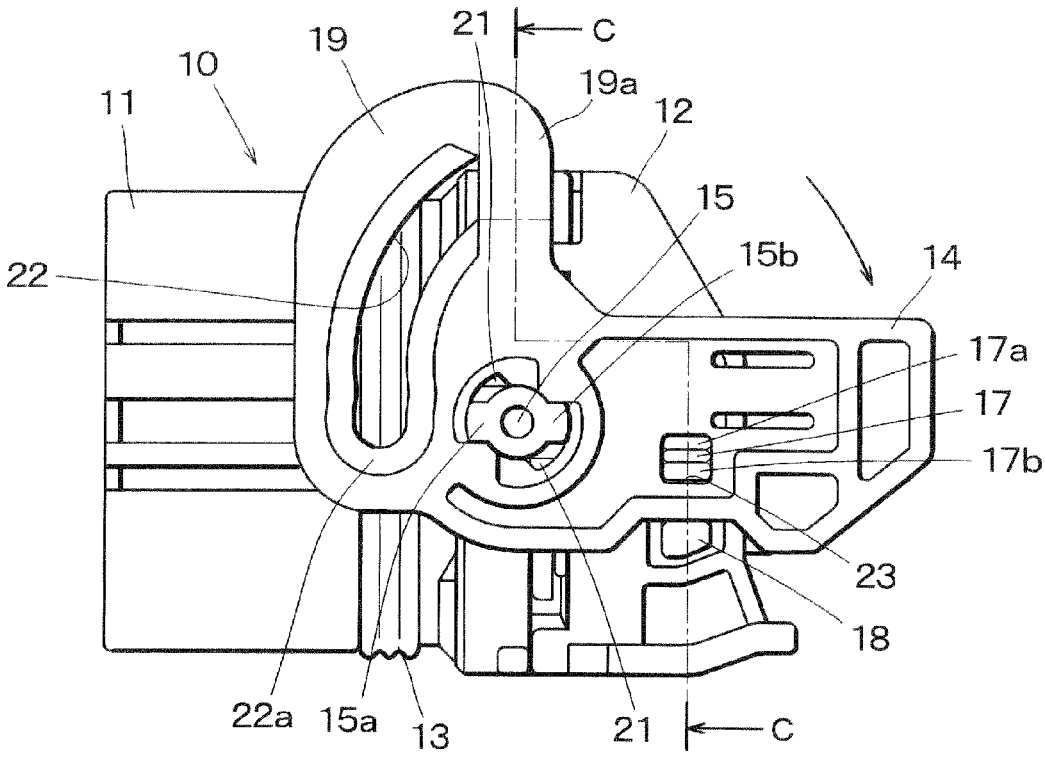
FIG. 5 is a side view depicting a condition in which the rotating lever has been rotated into a finally engaging position.
Figure 6:
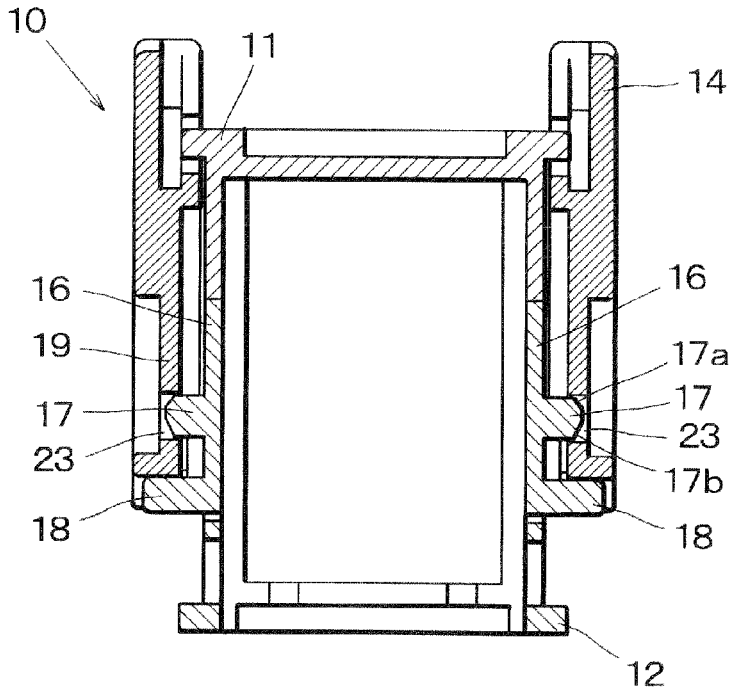
FIG. 6 is a cross sectional view cut along a line C-C in FIG. 5.

When the cooperating housing has been coupled with the relevant housing main body 11 into the finally engaged state, the locking claws 17 have been returned into original positions and have been inserted into the corresponding locking holes 23 as shown in FIGS. 5 and 6. Therefore, the rotating lever 14 could not be rotated any more and the rotation of the rotating lever 14 in a counter direction can be also prevented. In this manner, the rotating lever 14 is locked in position and the finally engaged condition of the cooperating housing with the relevant housing 10 can be stably maintained.

Figure 4:
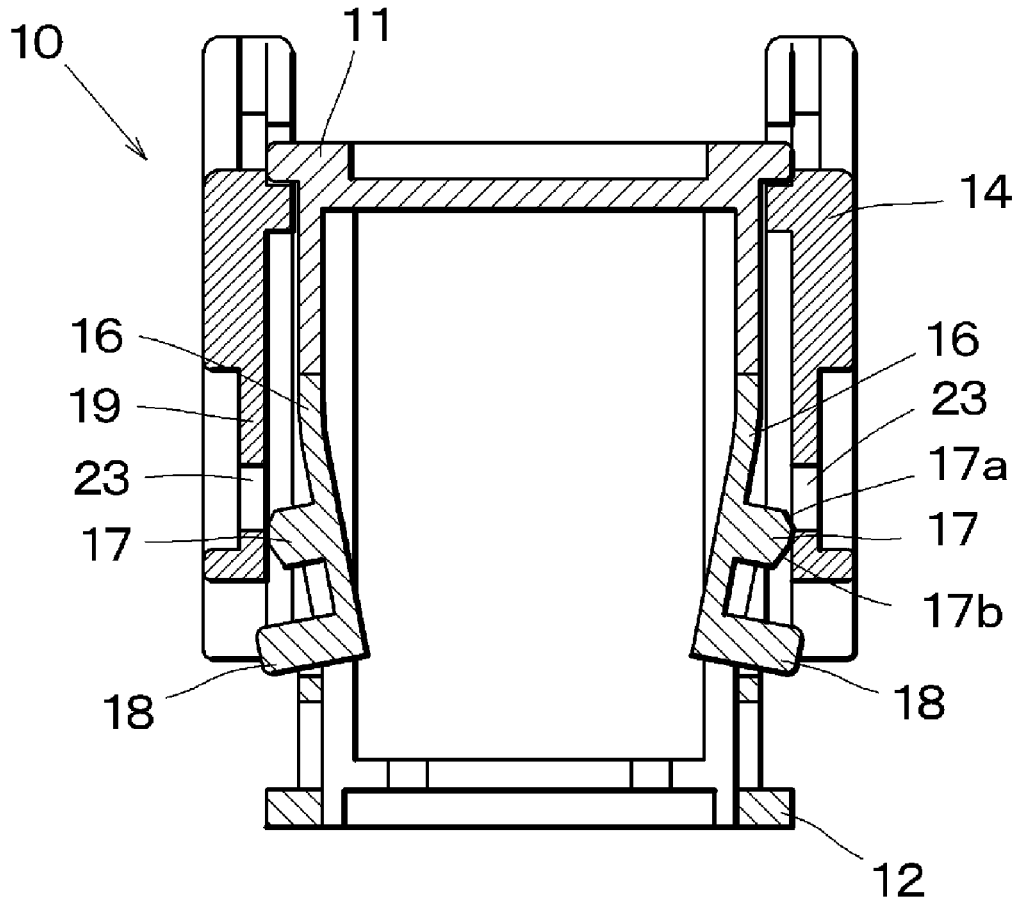
FIG. 4 is a cross sectional view cut along a line B-B in FIG. 3.

In order to decouple the cooperating housing from the relevant housing main body 11, the releasing projections 18 provided at tips of the movable members 16 are pushed inwardly by operator's fingers to bend the movable members 16 inwardly as depicted in FIG. 4 and to remove the locking claws 17 from the locking holes 23. Then, the rotating lever 14 may be rotated in the counter direction and the cooperating housing is pushed outwardly by the engagement of the cam slits 22 with the driven pins provided on the cooperating housing to release the engagement of the cooperating housing with the relevant housing 10. After that, the cooperating housing can be manually removed from the relevant housing main body 11.

What is claimed is:

1. A lever type connector comprising:

a first housing for accommodating a plurality of connecting terminals; and a rotating lever having a cam slit formed therein;

wherein said rotating lever is rotatable to pull a cooperating housing toward said first housing to attain an engaged condition in which said cooperating housing is engaged with said first housing and a plurality of connecting terminals accommodated by said cooperating housing are connected to said plurality of connecting terminals accommodated by said first housing;

wherein said first housing comprises a locking mechanism for engaging and locking a part of the rotating lever with a part of the first housing at a position to which the rotating lever is rotated to attain the engaged condition of the first housing with the cooperating housing; and wherein said locking mechanism comprises:

locking holes formed in side walls of said rotating lever;

resilient movable members having a substantially コ-shape provided in side walls of said first housing;

locking claws formed on said resilient movable members, said locking claws protruding outwardly and being engageable with said locking holes; and a release mechanism including releasing projections each provided at an end portion of a respective one of said movable members, wherein the releasing projections protrude outwardly farther than the locking claws, and wherein said locking claws are removable from the locking holes by pushing said releasing projections inward.

* * * * *